US006776585B2

(12) United States Patent
Loy et al.

(10) Patent No.: US 6,776,585 B2
(45) Date of Patent: Aug. 17, 2004

(54) CONTROL VALVE FOR A WOBBLEPLATE COMPRESSOR

(75) Inventors: Christoph Loy, Wolfenbüttel (DE); Klaus Gebauer, Wolfenbüttel (DE); Harry Nissen, Vechelde (DE); Heiko Dröse, Wolfenbüttel (DE); Thomas Reske, Braunschweig (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 10/195,323

(22) Filed: Jul. 16, 2002

(65) Prior Publication Data

US 2003/0017059 A1 Jan. 23, 2003

(30) Foreign Application Priority Data

Jul. 21, 2001 (DE) ..... 101 35 727

(51) Int. Cl.[7] ..... F04B 1/26
(52) U.S. Cl. ..... 417/222.2
(58) Field of Search ..... 417/222.2, 222.1; 251/129.05

(56) References Cited

U.S. PATENT DOCUMENTS

| | | | | | |
|---|---|---|---|---|---|
| 4,497,284 | A | * | 2/1985 | Schramm | 123/41.47 |
| 4,821,936 | A | * | 4/1989 | Osborn | 226/170 |
| 4,838,766 | A | * | 6/1989 | Kimura et al. | 417/222.2 |
| 4,848,101 | A | * | 7/1989 | Suzuki | 62/228.5 |
| 4,960,365 | A | * | 10/1990 | Horiuchi | 417/222.1 |
| 5,032,060 | A | * | 7/1991 | Kobayashi et al. | 417/222.1 |
| 5,145,326 | A | * | 9/1992 | Kimura et al. | 417/222.2 |
| 5,554,008 | A | * | 9/1996 | Porel | 417/269 |
| RE35,672 | E | * | 11/1997 | Taguchi | 417/222.2 |
| 6,102,668 | A | * | 8/2000 | Kawaguchi et al. | 417/222.2 |

FOREIGN PATENT DOCUMENTS

| | | | |
|---|---|---|---|
| DE | 3711979 | A1 | 10/1987 |
| DE | 3827075 | A1 | 2/1989 |
| DE | 4034686 | A1 | 5/1991 |
| DE | 19519441 | A1 | 12/1995 |
| DE | 19713413 | A1 | 11/1997 |
| DE | 4490105 | C2 | 1/1998 |
| DE | 19805126 | A1 | 8/1998 |
| DE | 19808323 | A1 | 9/1998 |
| DE | 19821498 | A1 | 11/1998 |
| EP | 0748937 | A2 | 12/1996 |

* cited by examiner

*Primary Examiner*—Justine R. Yu
*Assistant Examiner*—Timothy P. Solak
(74) *Attorney, Agent, or Firm*—Rabin & Berdo, P.C.

(57) ABSTRACT

A control valve for installation in a wobbleplate compressor with a changeable working volume is provided with an inlet for a connection to a pressure chamber, a first outlet for connection to a crank chamber, and a second outlet for connection to a suction chamber. A closing element cooperates with the second outlet and is acted upon by a device for controlling the gas mass flow.

23 Claims, 2 Drawing Sheets

CONTROL VALVE FOR A WOBBLEPLATE COMPRESSOR

CROSS REFERENCE TO RELATED APPLICATIONS

This application claims the priority of German Application No. 101 35 727.3, filed Jul. 21, 2001.

BACKGROUND OF THE INVENTION

The invention relates to a control valve for installation in a wobbleplate compressor with a changeable working volume, and that has an inlet for connecting it to a pressure chamber of the compressor. A first outlet is connectable to a crank chamber of the compressor. A closing element and means for acting upon the closing element are provided. The present invention is also directed to a wobbleplate compressor with a changeable working volume, in particular for use in a motor vehicle air conditioning system.

Wobbleplate compressors are used a great deal in vehicle air conditioning systems where they compress the cooling agent from the evaporator before it is supplied to a heat exchanger. Among other things, these rugged compressors have the advantage that they can also be used for compressing $CO_2$, which for environmental reasons has mostly replaced the fluorinated hydrocarbons used in the past as cooling agents.

Different types of cooling agents, such as $CO_2$, will in the future replace the cooling agents used so far, for example R134a, for environmental reasons. Since $CO_2$ must be compressed considerably more as compared to the cooling agents used so far, for example by a factor of 10, to obtain a comparable cooling output, the requirements with respect to the seal between the compressor housing and the environment, for example, and the control requirements, will also increase considerably.

Modern automobiles for the most part use wobbleplate compressors with a changeable working volume. For this usage, the wobbleplate is pivotally attached to a drive shaft, so that the angle of the wobbleplate with respect to the drive axis is changeable. By changing this angle, the working volume and—with a given revolutionary speed—the compressor output is changed. As a rule, the change in the angle is achieved by changing the inside pressure of the crankshaft housing, i.e., the crank chamber.

A wobbleplate compressor and a control valve for controlling and regulating the crank chamber pressure is known from reference EP 0 748 937 A2. The valve of this publication is an electromagnetic two-way valve, which connects a pressure chamber to the crank chamber through bores. The pressure of the crank chamber pressure is changed by opening and closing this valve. In principle, the known device can be used for controlling the crank chamber pressure, but a high control speed cannot be achieved with this device. A high control speed, however, is of considerable importance for many application cases.

SUMMARY OF THE INVENTION

Starting with this prior art, it is an object of the invention to modify a control valve for a wobbleplate compressor in such a way that it is possible to achieve a high control speed. This object is solved with a control valve having a second outlet for connecting it to a suction chamber of the compressor. A closing element cooperates with the second outlet. The object is also achieved with a wobbleplate compressor having such a control valve.

According to the invention, a three-way control valve is used, which has an additional outlet that is connected to the suction chamber. This additional outlet only is acted upon by a closing element, which means that the passage between the pressure chamber and the crank chamber is continuously opened. By opening and closing the output leading to the suction chamber, low pressure is "added to" the existing high pressure. A quick control is possible because the pressure differences in that case are very high.

Means for acting upon the closing element can include a coil and an armature that can move inside the coil. Thus, the closing element is indirectly acted upon by electromagnetic forces, which also contributes to a high control speed.

With a control valve having a coil that is supplied with an alternating voltage having a frequency above 100 Hz, and preferably approximately 500 Hz, a type of swimming control state can be obtained. Thus, the outlet connected to the suction chamber will never be quite open and never be quite closed. This contributes to a further increase in the control speed.

The wobbleplate compressor may have a safety valve, which connects the crank chamber to the suction chamber if the differential pressure between the crank chamber and the suction chamber exceeds a predetermined value. This configuration provides for particularly high operational safety.

The wobbleplate compressor may have piston rings arranged on the pistons. Further, the piston stroke may be larger than the piston diameter. Moreover, a pressure above 100 bar, preferably approximately 140 bar, may be generated on the high-pressure side. Further, the wobbleplate compressor may have a working volume of approximately 25–30 $cm^3$. Such a compressor is particularly suitable for use with a $CO_2$ air conditioning system.

DETAILED DESCRIPTION OF THE INVENTION

Figure 1:
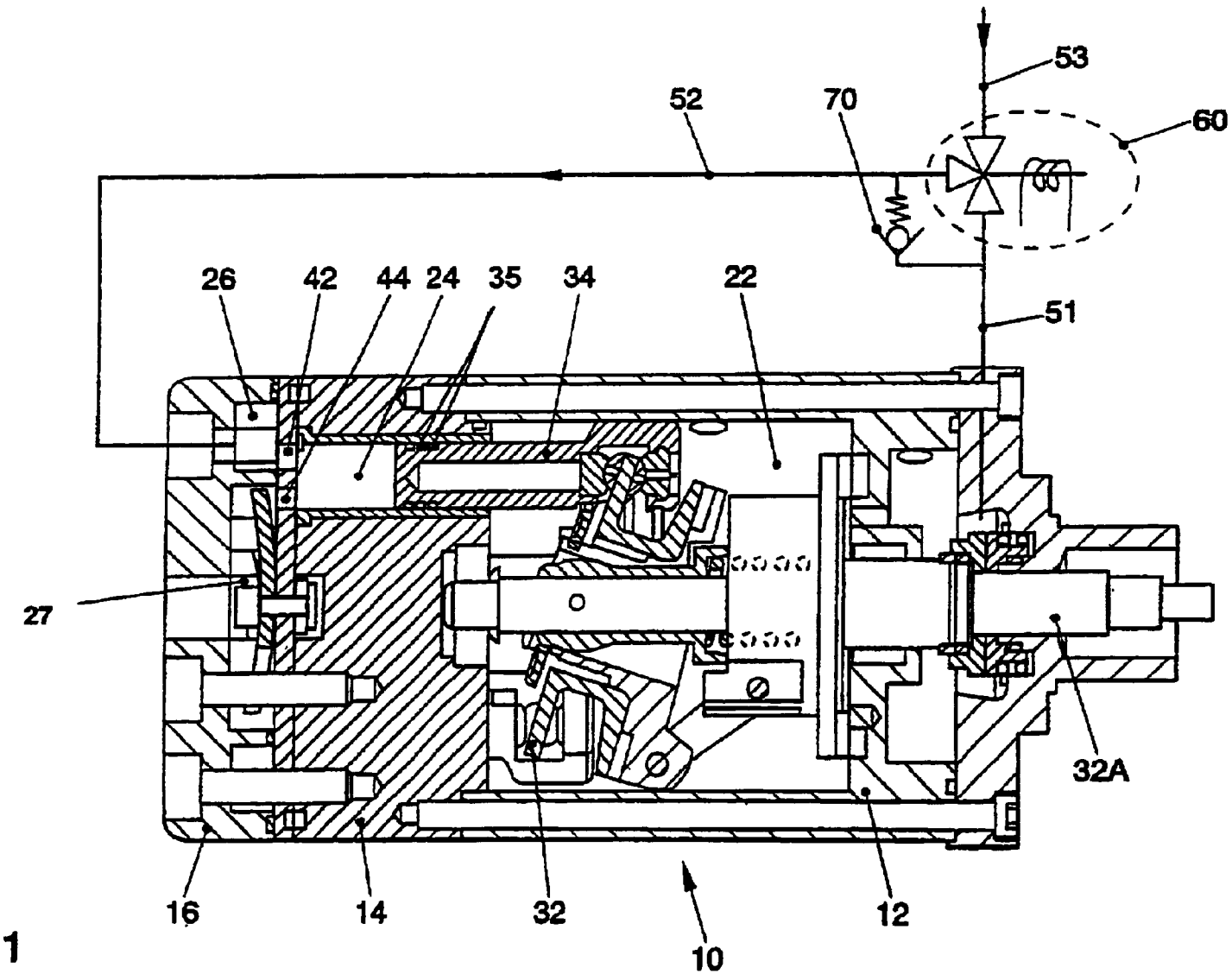
FIG. 1 is a cross sectional view through a wobbleplate compressor, wherein the valve according to the invention is shown schematically.

FIG. 1 shows a wobbleplate compressor, used in particular in a motor vehicle. A housing 10 includes a crank housing 12, a cylinder block 14 and a cylinder head 16. Inside the crank housing 12 is a crank chamber 22, in which a wobbleplate 32 is arranged such that it can swivel on the shaft 32A. The wobbleplate 32 is connected via sliding blocks to a piston 34 to drive the piston. Although not shown, there may be a plurality of pistons 34. By changing the angle of inclination of the wobbleplate 32, the working volume and thus—with a given rotational speed—the output of the wobbleplate compressor is changed. For example, if the wobbleplate 32 is positioned perpendicular to the shaft 32A, the working volume is zero.

The suction chamber 26 is located inside the cylinder head 16 and is connected to a cooling agent evaporator, which is not shown herein. The decompressed gas travels via inlet valve 42 from the suction chamber 26 into the cylinder 24. From there, the gas is pushed with a corresponding piston movement through outlet valve 44 and into the pressure chamber 27, which in turn is connected to a heat exchanger that is not shown herein.

The piston 34 is provided with a circumferential groove or grooves for accommodating piston rings 35. The respective piston rings 35 are preferably made from gray cast iron. The piston rings generate the pressures needed for a $CO_2$ air conditioning system.

The wobbleplate compressor may be configured for use in a $CO_2$ air conditioning system, by providing the piston stroke to be larger than the piston diameter. For example, the piston stroke can be 21 mm while the piston diameter is 16 mm. When six cylinders are provided, the total working volume of the six cylinders thus amounts to approximately 25 $cm^3$. During the operation, a pressure of approximately 140 bar exists on the high-pressure side, while a pressure of approximately 40 bar exists on the suction side. The tilting of the wobbleplate 32 (and thus also the working volume) is controlled via the pressure in the crank chamber 22. In this case, it is true that the larger the working volume, the lower the pressure inside the crank chamber 22 and vice versa.

The control valve 60 is used to control the crank chamber pressure. This valve is a three-way valve with the following connections: an inlet 63, a first outlet 61 and a second outlet 62. The inlet 63 is connected via a pressure line 53 of a passage to the pressure chamber 27. The first outlet 61 is connected via the control line 51 of the passage to the crank chamber 22. The second outlet 62 is connected via the suction line 52 to the suction chamber 26.

Figure 2:
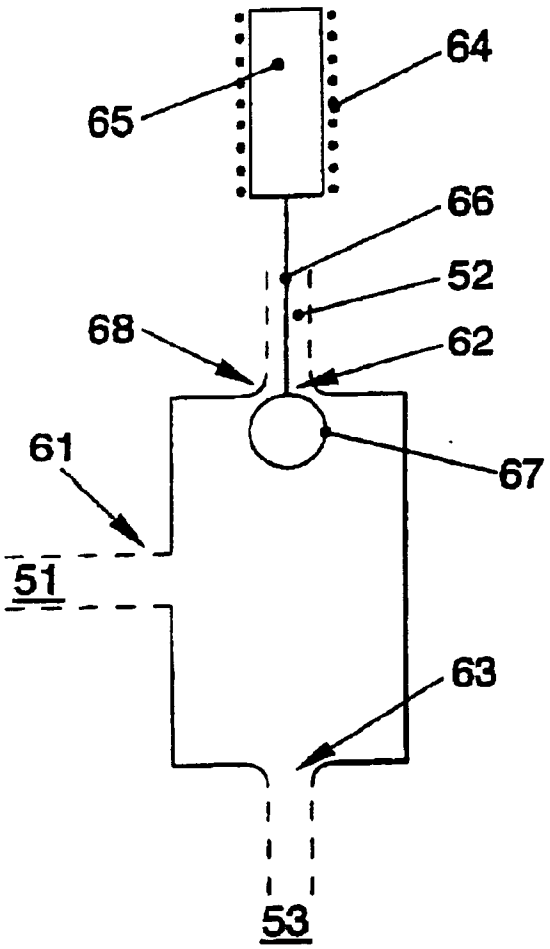
FIG. 2 is a schematic representation of a three-way valve according to the present invention.

As shown in FIG. 2, the effective diameter of the second outlet 62 is controlled with the first ball 67. As a result of the pressure conditions, the first ball 67 is pushed onto the valve seat 68, so that the second outlet 62 is closed if no counter force is acting upon the ball.

The first ball 67 can be pushed away from the second outlet 62 by means of a tappet 66. The tappet 66 is connected to an armature 65, which in turn is enclosed by a coil 64, so that a change in the coil current results in a linear movement of the armature 65 and thus also the tappet 66. By controlling the coil current, the effective diameter of the second outlet 62 can thus be controlled. The coil is preferably actuated with a frequency of approximately 500 Hz, so that a so-called "swimming control condition" results. In this case, the second outlet 62 is never quite fully opened and never quite fully closed. The average effective opening is controlled via the amount of coil current. This high-frequency operation further increases the control speed that can be achieved.

The pressure chamber 27 and the crank chamber 22 are constantly connected, i.e. in constant fluid communication, with the aid of the 3-way valve. The crank chamber pressure is controlled in that a portion of the gas mass flow, flowing from the pressure chamber 27 to the crank chamber 22, may be branched off into the suction chamber 26. If the valve is opened wide, a great deal of gaseous cooling agent flows off into the suction chamber 26, thus causing the pressure inside the crank chamber 22 to sink. Due to the high pressure difference between pressure chamber 27 and suction chamber 26, correspondingly high flow speeds for the gas are generated, which leads to a correspondingly fast pressure drop inside the crank chamber 22 and thus to a high control speed.

A safety valve 70 is preferably arranged between the suction line 52 and the control line 51, or directly between the suction chamber 26 and the crank chamber 22. This safety valve 70 has a purely mechanical design, so that even if there is a failure in the electronic system, any excess pressure is prevented from accumulating inside the crank chamber 22, which could lead to damage to the compressor.

Figure 3:
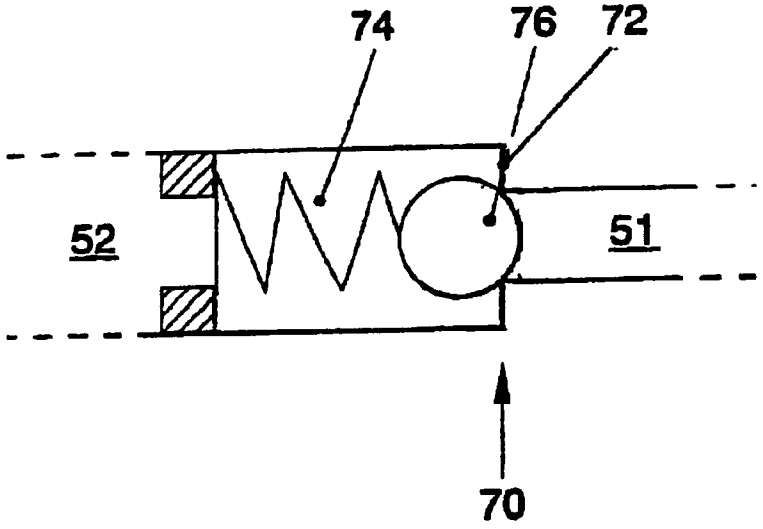
FIG. 3 is a schematic representation of a safety valve according to the present invention.

FIG. 3 shows one exemplary embodiment of the safety valve 70. A second ball 76 is pushed by means of a pressure spring 74 onto a saddle 72. The pressure spring 74 in this case counteracts the pressure drop between crank chamber 22 and suction chamber 26. If the pressure difference exceeds a predetermined value, then the pressure spring 74 is compressed and the second ball 76 is thus lifted off the saddle 72. Excess pressure in the crank chamber 22 is discharged to the suction chamber 26 until the level falls below the predetermined pressure difference value and the safety valve closes again.

The lines and valves are shown only schematically in FIG. 1. However, the lines may be formed as bores in the housing 10 and the valves may be arranged inside the housing.

It should be understood, however, that the invention is not necessarily limited to the specific process, arrangement, materials and components shown and described above, but may be susceptible to numerous variations within the scope of the invention.

It will be apparent to one skilled in the art that the manner of making and using the claimed invention has been adequately disclosed in the above-written description of the preferred embodiments taken together with the drawings.

It will be understood that the above description of the preferred embodiments of the present invention are susceptible to various modifications, changes and adaptations, and the same are intended to be comprehended within the meaning and range of equivalents of the appended claims.

What is claimed is:

1. A control valve for installation in a wobbleplate compressor having a changeable working volume, comprising:

an inlet adapted to be connected to a pressure chamber of the wobbleplate compressor;

a first outlet adapted to be connected to a crank chamber of the wobbleplate compressor;

a second outlet adapted to be connected to a suction chamber of the wobbleplate compressor;

a closing element that cooperates with the second outlet; and means for acting upon the closing element to increase and decrease a size of the second outlet, without fully closing or fully opening the second outlet.

2. A wobbleplate compressor with a changeable working volume, for use in a motor vehicle air conditioning system, comprising:

a suction chamber;

a pressure chamber;

a crank chamber;

a wobbleplate arranged in the crank chamber, an inclination of the wobbleplate being changeable; and a control valve, the crank chamber being connected via the control valve to the pressure chamber, the control valve including:

an inlet connected to the pressure chamber via the pressure line;

a first outlet connected to the crank chamber via the control line;

a second outlet connected to the suction chamber;

a closing element that cooperates with the second outlet; and means for acting upon the closing element to increase and decrease a size of the second outlet, without fully closing or fully opening the second outlet.

3. A control valve for installation in a wobbleplate compressor having a changeable working volume, comprising:

an inlet adapted to be connected to a pressure chamber of the wobbleplate compressor;

a first outlet adapted to be connected to a crank chamber of the wobbleplate compressor, the first outlet being in constant fluid communication with the inlet;

a second outlet adapted to be connected to a suction chamber of the wobbleplate compressor;

a closing element that acts only upon the second outlet; and means for acting upon the closing element to increase and decrease a size of the second outlet.

4. The control valve according to claim 3, wherein the means for acting upon the closing element comprises a coil, and an armature that is movable inside the coil.

5. The control valve according to claim 4, wherein the closing element is a first ball.

6. The control valve according to claim 4, wherein the coil is supplied with an alternating voltage having a frequency above 100 Hz.

7. The control valve according to claim 6, wherein the closing element is a first ball.

8. The control valve according to claim 6, wherein the frequency is approximately 500 Hz.

9. The control valve according to claim 8, wherein the closing element is a first ball.

10. The control valve according to claim 3, wherein the closing element is a first ball.

11. A wobbleplate compressor with a changeable working volume, for use in a motor vehicle air conditioning system, comprising:

a suction chamber;

a pressure chamber;

a crank chamber connected to the pressure chamber via a passage that is always open, the passage including a pressure line and a control line;

a wobbleplate arranged in the crank chamber, an inclination of the wobbleplate being changeable; and a control valve, the crank chamber being connected via the control valve to the pressure chamber, the control valve including:

an inlet connected to the pressure chamber via the pressure line;

a first outlet connected to the crank chamber via the control line;

a second outlet connected to the suction chamber;

a closing element that acts only upon the second outlet; and means for acting upon the closing element to increase and decrease a size of the second outlet.

12. The wobbleplate compressor according to claim 11, wherein the means for acting upon the closing element comprises a coil, and an armature that is movable inside the coil.

13. The wobbleplate compressor according to claim 12, wherein the coil is supplied with an alternating voltage having a frequency above 100 Hz.

14. The wobbleplate compressor according to claim 13, wherein the frequency is approximately 500 Hz.

15. The wobbleplate compressor according to claim 11, wherein the closing element is a first ball.

16. The wobbleplate compressor according to claim 11, further comprising a safety valve that communicates the crank chamber with the suction chamber if a differential pressure between the crank chamber and the suction chamber exceeds a predetermined value.

17. The wobbleplate compressor according to claim 16, wherein the safety valve includes a pressure spring and a second ball.

18. The wobbleplate compressor according to claim 11, further comprising at least one piston connected to and driven by the wobbleplate, and at least one piston ring disposed on the piston.

19. The wobbleplate compressor according to claim 18, wherein a stroke of the piston is larger than a diameter of the piston.

20. The wobbleplate compressor according to claim 18, wherein the piston generates a pressure in the pressure chamber that is above 100 bar.

21. The wobbleplate compressor according to claim 20, wherein the pressure in the pressure chamber is approximately 140 bar.

22. The wobbleplate compressor according to claim 11, wherein the working volume is a maximum of approximately 25–30 $cm^3$.

23. A wobbleplate compressor with a changeable working volume, for use in a motor vehicle air conditioning system, comprising:

a suction chamber;

a pressure chamber;

a crank chamber;

a wobbleplate arranged in the crank chamber, an inclination of the wobbleplate being changeable;

a control valve, the crank chamber being connected via the control valve to the pressure chamber the control valve including:

an inlet connected to the pressure chamber via the pressure line;

a first outlet connected to the crank chamber via the control line;

a second outlet connected to the suction chamber;

a closing element that cooperates with the second outlet; and means for acting upon the closing element to increase and decrease a size of the second outlet; and a safety valve that communicates the crank chamber with the suction chamber if a differential pressure between the crank chamber and the suction chamber exceeds a predetermined value.

* * * * *